United States Patent [19]

Allwin et al.

[11] Patent Number: 4,712,614

[45] Date of Patent: Dec. 15, 1987

[54] LINER HANGER ASSEMBLY WITH COMBINATION SETTING TOOL

[75] Inventors: Roger P. Allwin, College Station; Mark P. Budke, Bryan, both of Tex.

[73] Assignee: Lindsey Completion Systems, Midland, Tex.

[21] Appl. No.: 901,835

[22] Filed: Aug. 29, 1986

[51] Int. Cl.[4] ..... E21B 23/00

[52] U.S. Cl. ..... 166/208; 166/217

[58] Field of Search ..... 166/208–212, 166/214, 215, 217, 123–125, 136–138, 382

[56] References Cited

U.S. PATENT DOCUMENTS

| | | | |
|---|---|---|---|
| 3,012,612 | 12/1961 | Wright et al. | 166/208 |
| 3,285,345 | 11/1966 | Solum | 166/208 |
| 4,096,913 | 6/1978 | Kenneday et al. | 166/208 |
| 4,393,931 | 7/1983 | Muse et al. | 166/208 |
| 4,497,368 | 2/1985 | Baugh | 166/208 |
| 4,603,743 | 8/1986 | Lindsay, Jr. | 166/212 |

*Primary Examiner*—Stephen J. Novosad
*Assistant Examiner*—Bruce M. Kisliuk

[57] ABSTRACT

A setting tool and liner hanger where the liner hanger has a threaded release section and elongated slip slots for receiving slips. The slips have inclined upper surfaces and inclined tongue and groove interconnections along the sides of the slots defining expander surfaces. The setting tool has a unitary actuating mechanism which can be hydraulically actuated or can be mechanically actuated. Dog members are on the actuating mechanism are releasably connected to internal grooves in the slip members. For hydraulic actuation, hydraulic pressure moves the connected dog members for setting the slips in a well casing. The mechanical actuator operates in response to relative rotation between the setting tool mandrel and liner hanger for releasing a spring force on dog members to move the slips to a setting condition. The tool is raised to a location to set the slips and to release the setting tool from the liner hanger.

When the liner is hung or set, upon release of the coupling nut on the setting tool from the liner hanger, the dog members are releasable from the slips so that the entire setting tool is releasable from the liner hanger.

28 Claims, 4 Drawing Figures

LINER HANGER ASSEMBLY WITH COMBINATION SETTING TOOL

FIELD OF INVENTION

This invention relates to setting tools and liner hangers for setting liners in well bores traversing earth formations, and more particularly, to setting tools and liner hangers which can be selectively mechanical or hydraulically set and incorporate the operating mechanisms in a single unit within a setting tool.

BACKGROUND OF THE PRESENT INVENTION

In the drilling, or completion of wells traversing earth formations, the first section of borehole is drilled from the earth's surface to a selected depth and lined with a tubular pipe which is cemented in place and commonly referred to as a surface casing. In the next succeeding section of borehole drilled, a tubular pipe commonly called a liner is lowered into the borehole. The top of the liner is coupled to a liner hanger and the liner hanger is releasably connected to a setting tool. The setting tool is connected to a work string or drill pipe which lowers the liner into the open borehole below a casing until the liner hanger is adjacent to or near the lower end of the casing and the lower end of the liner is above the bottom of the open borehole. The liner carries conventional cementing equipment such as a cementing shoe, float collars and plug catchers. The borehole is filled with fluid such as drilling mud which is bypassed around the liner and liner hanger as the liner is run in the borehole. For a number of reasons it is desirable to have the outside of the liner or its diameter as large as possible to pass through the casing and the inside diameter of the liner hanger and liner which remains in the borehole as large as possible. Thus, as additional liners are disposed in drilled sections of a well bore, the size and length of the additional liners can be maximized thus enabling larger downhole liner bores at greater depths from the earth's surface. In other words it is desirable to minimize the effective annular wall thickness of a liner hanger as well as minimize the components of the liner hanger left with the liner in the well bore after the setting tool is released from the liner hanger and retrieved to the surface.

In an operation for hanging a liner, the liner and liner hanger are lowered through the mud or fluid filled surface casing and/or liners to the open borehole. When the liner reaches a desired location relative to an open borehole and an upper casing, a mechanism in the setting tool is actuated to move slips or slip members on the liner hanger from a retracted position to an extended position in engagement with the well casing. Thereafter, when weight is applied to the hanger slips, (i.e. the weight of the liner by slacking off on the drill pipe,) the slips are set and hang the liner in the well casing. Thereafter, the setting tool mandrel is again slacked off ("lowered") and rotated to the right by the drill string to rotate and release a lefthand threaded release nut on the setting tool from the liner hanger. Generally, the setting tool also has a sealing or pack-off device in sliding and sealing relationship to a bore in the liner hanger or liner after the setting tool nut is released from the liner hanger. At this time the setting tool is supported with the pack-off device in the sealing bore of the liner hanger so that there is a continuous bore from the earth's surface to the bottom of the liner. When cement is pumped through the continuous bore formed by the drill string, the liner, and the cementing equipment, the cement is displaced into the annulus between the liner and the borehole. Following cementing of the drill string in the open borehole, the setting tool is retrieved and the drilling or completion operations continued.

The setting tool can have hydraulically operated setting mechanism for the hanger slips or can have mechanically operated setting mechanism for the hanger slips. A hydraulically operated setting mechanism typically employs a hydraulic cylinder means which is actuated by pressure in the bore of the drill string. Pressure is obtained by dropping a pump down ball through the drill string to seat in a ball valve sleeve in the liner below the hydraulic setting mechanism. The ball valve sleeve is shear pinned to the liner and seats the ball so as to close off the bore of the valve sleeve. Thus, fluid under pressure is then used to actuate the hydraulic cylinder means to set the hanger slips. When the hanger slips are set, an increase in pressure permits shearing of the shear pin in the ball valve sleeve releasing the valve and opening the bore for subsequent application of cement.

In a mechanically set liner hanger, it is usually necessary to obtain a relative downhole rotation of parts in a setting tool and liner hanger to release the hanger slips or to release a spring force which mechanically acts upon the slips. The effect of a spring force upon release of the slips is to move the slips upwardly relative to an expander and also to move the slips outwardly. The hanger slips are then one-way acting in that the hanger and liner can be raised or lifted upwardly but a downward motion of the liner sets the slips to hang the liner in a well casing.

Separate hydraulic and mechanically operated devices have been separately incorporated in a well hanger and setting tool so that either setting device could be used for hanging a liner. The use of two different devices in a setting tool and liner hanger is desirable as trips in a well bore are expensive and time consuming. If the hydraulic mechanism fails or if resetting of a liner is contemplated, selective use of mechanical or hydraulic actuating means is desirable. However, such devices have heretofor required incorporation of parts of the actuators in the liner hanger and have involved long tool lengths.

The present invention is concerned with a hydraulic and/or mechanical setting tool for a liner hanger where the setting tool carries substantially all of the hydraulic and mechanical actuating devices in a single unit on the setting tool for retrieval with the setting tool. The liner hanger has a slip design which interacts with the setting tool mechanism and minimizes the annular wall thickness of the liner hanger and has substantial strength for supporting heavy and long liners.

THE PRESENT INVENTION

The present invention includes a liner hanger for a liner in which the liner hanger has an internal, left hand thread providing a releasable connection to a threaded release nut on a setting tool. In the liner hanger are elongated, vertically disposed slip elements circumferentially disposed about the liner hanger and disposed in elongated slots. The elongated slots each have an upper end surface which is inclined to form an expander surface. Along each side of each slot are inclined tongues and grooves which are inclined at a similar angle as the inclination angle of expander surface and slidably interfit with tongue and grooves on the slip elements. Thus, the slips have side surfaces and an end surface which are load bearing with respect to the hanger and provide a substantial load support for a liner. In addition, the slips in a contracted position within the liner hanger have the outer serrated surface below the outer surface of the liner hanger and provide a thin wall annular construction of the hanger.

The setting tool includes a setting tool release nut with an external lefthand thread for releasably connecting the setting tool to the liner hanger. The release nut is slidably and non-rotatably mounted on an tubular inner member of the setting tool. Also, at the lower end of the inner member is a sealing assembly arranged for a sliding and sealing relationships with the liner hanger bore and a ball sleeve valve which is shear pinned to the inner member. The sleeve valve is sized to receive a sealing ball for hydraulic operation of the setting tool.

In the disclosed embodiment, a hydraulic actuating mechanism and a mechanical spring actuating mechanism are incorporated into one actuating mechanism that connects to a common dog actuating member for a slip element.

When the hydraulic actuator is operated, the dog members on the setting tool set the slip members on the liner hanger by hydraulic pressure applied to move the dog members and the slip members upwardly and outwardly. The slip members are moved on the expander by virtue of the tongue and groove surfaces. Upon rotation of an inner member on a setting tool to disconnect the release nut, a release means for the mechanical actuator is actuated for releasing a spring force in the mechanical actuator. The spring force is, however, not necessary since the slips are set hydraulically. Upon release of the release nut from the liner hanger, an upward movement of the inner member of the setting tool disables the dog members so that the setting tool and the actuators are capable of removal as a unit from the liner hanger leaving only the hanger slips and the hanger in the borehole. Thereafter, the liner is cemented in place and the setting tool is retrieved as a unit.

When the mechanical actuator is operated independent of the hydraulic actuator, the actuation is obtained by relative rotation between the liner hanger and the inner member of the setting tool. One way to obtain relative rotation is to set the liner on the bottom of the bore hole. Upon relative rotation, the spring force of the spring actuation mechanism is released and applied to the dog members for moving the slip members upward and outwardly into contact with the well bore. Thereafter, the inner member can be raised to locate the liner hanger to at a desired location where downward movement of the drill pipe and liner sets the slips and hangs the liner hanger. Thereafter, the setting tool release nut is released, the liner is cemented in place and the setting tool is retrieved as a unit.

DESCRIPTION OF INVENTION

Figure 1:
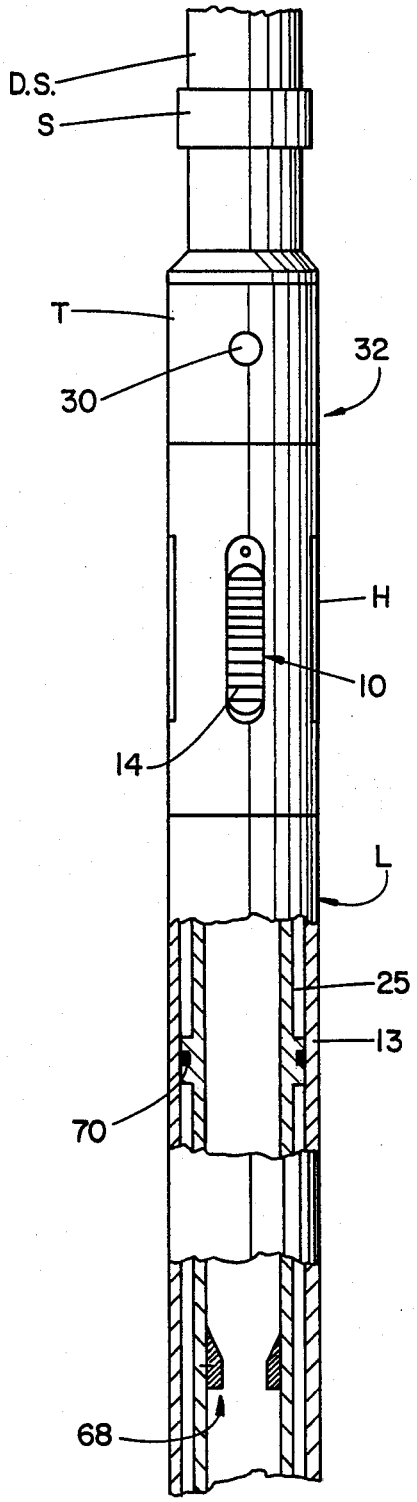
FIG. 1 is a view in partial cross-section of a setting tool and liner hanger.

Referring now to FIG. 1, a liner L is coupled to a liner hanger H which has circumferentially disposed slip elements or slips 10 for gripping engagement with a well casing. The slip elements 10 are normally disposed within the outer wall of the liner hanger so that the slips do not project outwardly of the circumferential outer surface of the liner hanger H. The slip elements or slips 10 are movable radially outward to bring outer serrated surfaces of the slips into gripping engagement with the inner wall of a well casing. The liner hanger and liner are releasably connected to a setting tool T which, in turn, is connected to a work or drill string DS by a sub S. Thus, the work string can be used to lower and manipulate the liner and liner hanger prior to setting the liner.

Figure 2:
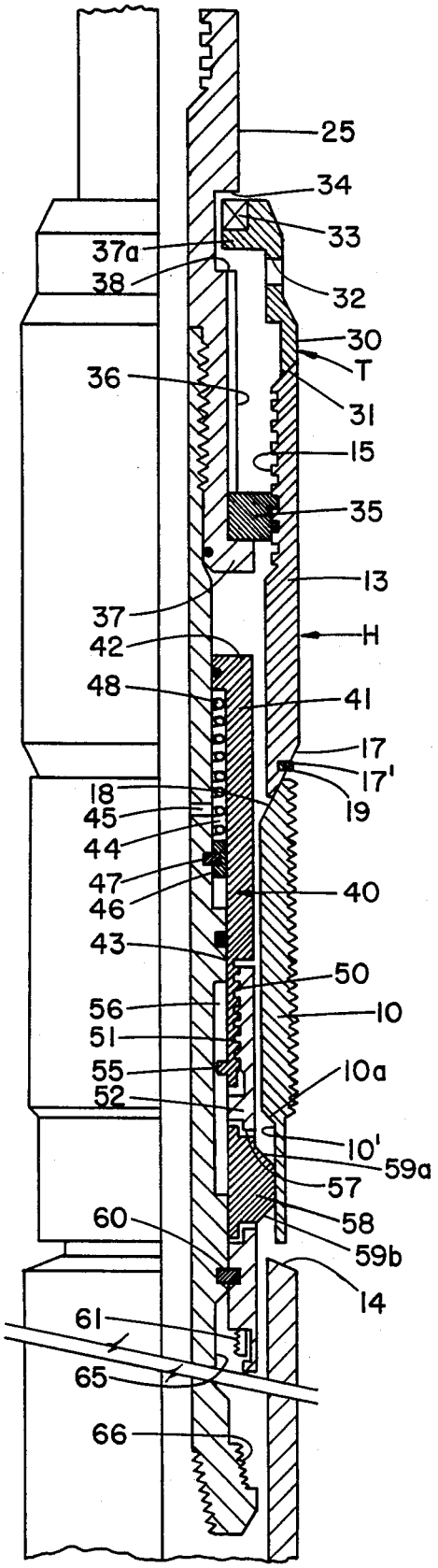
FIG. 2 is a view in longitudinal cross-section of a setting tool and liner hanger.
Figure 3:
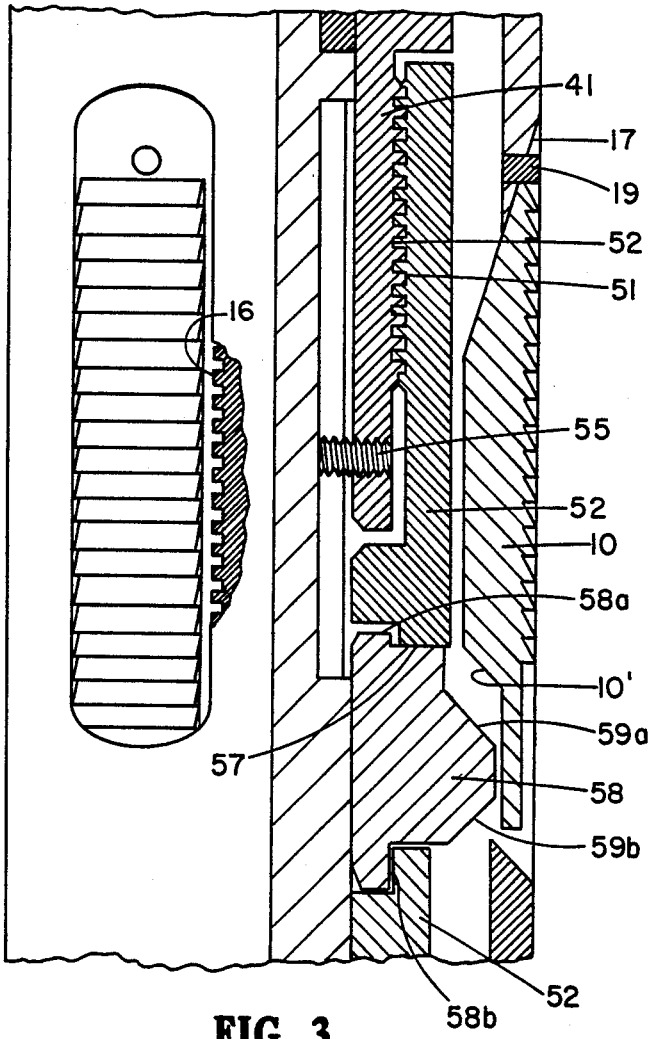
FIG. 3 is a view in partial cross-section through a slip element.
Figure 4:
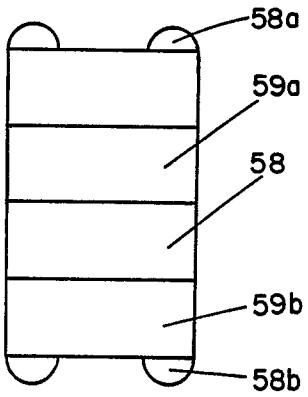
FIG. 4 is a plan view of a dog element.

Referring now to FIG. 2, the liner Hanger H includes a tubular outer member 13 which has elongated, circumferentially spaced slip slots 14 (See FIG. 1) and is attachable at its lower end to a liner. At the upper end of the outer member 13 is an internal left-hand thread 15. The side edges of the slips 10 and the side edges of the slots 14 have sliding, inclined tongue and groove connections 16 (See. FIG. 3) which provide for sliding movement between the contracted unset position shown and an extended position in engagement with the wall of a well casing. At the upper end of each slot 14 is an inclined surface 17. A complimentarily inclined surface 18 on a slip is arranged to move parallel to the surface 17. Surfaces 17 and 18 may be in sliding contact or may be separated from one another as the tongue and groove slots provide the appropriate expander sliding and load supporting surfaces. The inclined surface 17 and keyed tongue and groove slots constitute expander means for a slip member. A shear pin 19 is disposed on the inclined surface 17 to releasably retain a slip in a retracted position.

The setting tool T includes a tubular inner member 25 which is attachable at its upper end to a drill string. The inner member 25 carries a bearing housing 30, a release nut 35 and a unitary hydraulic-mechanical actuator means 40. The bearing housing 30 has a lower end 31 adapted to engage the upper end of the outer member 13. The housing 30 has a number of bypass ports 32. The upper end of the housing 30 contains a rotational bearing 33. The rotational bearing 33 on the housing 30 is engagable with a downwardly facing shoulder 34. The housing 30 includes a flange **37*a* below the bearing 33 and the flange 37 and bearing 33 are contained between the downwardly facing shoulder 34 and an upwardly facing shoulder 38 on the inner member 25. Below the shoulder 38, the inner member 25 has a section of non-circular cross-section forming splines 36 which slidably and non-rotatively receive a non-circular bore in the release nut 35. The release nut 35 has external left-hand threads which threadably and releasably engage with the internal threads 15 in the outer member 13. The release nut 35 and threads 15 define interconnecting means for releasably interconnecting the inner and outer members. Below the nut 35, the inner member 25 has a flange 37 which supports the nut 35 and hence the liner on the inner member 25. Below the flange 37 is the unitary hydraulic-mechanical actuator means 40 which includes an outer actuator sleeve member 41 slidably mounted on the inner member 25. The sleeve member 41 has inwardly facing flange 42 with a sealing means bearing against the inner member 25** and the inner member 25 has an outwardly facing flange 43 with a sealing means bearing against the inner wall of the sleeve member 41. Between the flanges 42 and 43, an annular chamber 44 is defined and a port 45 provides fluid access from the bore of the inner member 25 to the annular chamber 44. Near the lower end of annular chamber 44 an annular stop ring 46 is connected by a shear pin 47 to the inner member 25. Between the stop ring 46 and the upper flange 42 is a spring 48 under compression.

The structure defining the annular chamber 44 defines a hydraulic-mechanical actuator means which is movable between contracted and expanded positions.

At the lower end of the sleeve member 41 is an externally threaded section 50 which engages with a threaded section 51 on a tubular dog collar 52. The lower end of the sleeve member 41 also has a pin member 55 which is slidably received in a longitudinal guide or key slot 56 in the inner member 25. The sections 50 and 51, when released from a threaded interconnection, permit the sleeve member 41 to be moved upwardly by the spring 48. The releasable connection thread 15 in the outer member 13 is made with a substantially greater number of threads than the number of threads on threaded section 51. In practice, twenty turns or rotations are required to release the nut 35 while eighteen turns or rotations of the drill string are required to release the thread 51.

As shown in FIG. 3, the dog collar 52 has rectangular slots 57 which slidably receive rectangular dog members 58. The dog members 58 have ears 58*a*, 58*b*, on a base portion projecting beyond the opening of a slot 57 so that a dog member 58 cannot fall out of a slot. The ends of the dog members 58 which project outwardly from the dog collar 52 have inwardly tapered surfaces 59*a* and 59*b* and are disposed in a recess 10' in the lower end of a slip 10.

As shown in FIG. 2, in the lower end of the dog collar 52 a shear pin 60 releasably connects the dog collar 52 to the inner member 25. At the lower end of the dog collar 52 is a resilient annular ratchet ring 61 with internal ratchet teeth. The ring 61 is contained in an internal recess in the end of the dog collar 52. The dog collar 52 defines slip actuator means for moving the slip means in response to the hydraulic-mechanical actuator means. The shear pin 60 is a release means for holding the actuator means in a contracted position while the spring is compressed.

In the position shown the inner member 25 has an unlocking recess 65 and an external annular ratchet 66 at its lower end. The recess 65 and ratchet 66 are arranged so that when the ratchet 66 engages the ratchet ring 61, the recess 65 is disposed under the dog members 58.

In the operation of the tool, the hanger slips 10 can be set either mechanically or hydraulically. For hydraulic setting, the liner, liner hanger, setting tool and drill string are lowered to the level in the borehole or casing where the hanger is to be set. A sealing ball (not shown) is dropped through the drill string to a ball catcher 68 (FIG. 1) which is in the inner member 25 of the setting tool. The inner member 25 is sealed off relative to the outer member 13 by a sealing means 70 (See FIG. 1). By pressuring up on the fluid in the drill string, pressure in the annular chamber 44 shears the pin 60 first and then the hydraulic force on the sleeve member 41 (as well as the spring force) moves the dogs 58 upwardly engaging the lower end of the slips 10. The shear pin 19 for a slip 10 is sheared and the slips are moved outwardly along the inclined surfaces 17 to engage the well casing for supporting the weight of the liner. The drill string is lowered and right hand rotation of the drill string unthreads the nut 35 from the outer member 13. At the same time the sleeve member 41 unscrews from the dog collar 52 (at the threaded connection 50 and 51) so that the inner member can be disengaged from the outer member 13. Upon moving the drill string upwardly, the ratchet 66 on the inner member 25 engages the ratchet ring 61 and the recess 65 permits the dogs 58 to be released and moved inwardly from the slips so that the dogs are locked in position relative to the recess 65. The entire setting tool assembly is retrieved leaving only the slips and the liner hanger in the casing.

To set the hanger mechanically, the liner is brought into engagement with the bottom of a well bore so that the inner member 25 can be rotated relative to the outer member 13. By rotating the drill string, the shear pin 60 is sheared and the spring 48 moves the sleeve element 41 and dog member 52 upwardly. The spring force of the spring 48 causes the dogs 58 to be moved to a position in engagement with the slip shoulder 10*a*. Upon lifting the drill string in an upward direction, the flange 37 below the nut 35 contacts the nut 35. Continued upward pull on the drill string shears the shear pin 19 and releases the slips 10. The drill string then is used to move the liner to the desired location while the slips are dragged along the well bore surface and are being pushed outwardly by the spring force only. At the desired location for hanging the liner, the drill string is lowered thus setting the slips 10 and hanging the liner in a well casing. Next, the drill string is lowered and the nut cover 30 is in engagement with the outer member 13 so that rotation of the drill string releases the nut 35 and the setting tool from the outer member 13 of the liner hanger. At this time, the inner member 25 can be raised so that the ratchet 66 engages the ratchet ring 61 and the release groove or recess 65 releases the dogs 58 from the slip elements.

It will be apparent to those skilled in the art that various changes may be made in the invention without departing from the spirit and scope thereof and therefore the invention is not limited by that which is enclosed in the drawings and specifications, but only as indicated in the appended claims.

We claim:

1. A setting tool and liner hanger for setting a liner in a well bore traversing earth formation which include:

a tubular outer member adapted for coupling to a liner, said outer member having slip means circumferentially disposed about said outer member and arranged for movement between a contracted unset position within the circumference of the outer surface of the outer member and an extended setting position where the slip means engage the wall of a well bore;

a setting tool having a tubular inner member arranged for coupling to a drill or work string, interconnecting means for releasably interconnecting said inner member and said outer member, hydraulic-mechanical actuator means carried by said inner member and having a hydraulic cylinder movable between contracted and expanded positions, spring means cooperating with said cylinder for providing a mechanical force, said cylinder having access to the bore of said inner member for the application of hydraulic pressure;

slip actuator means for moving said slip means in response to operation of said hydraulic-mechanical actuator means, release means for releasably retaining said actuator means in a contracted position on said inner member, said release means being operable in response to hydraulic pressure to said cylinder or operable in response to relative rotation between said tubular inner member and said slip actuator means to release said mechanical force.

2. The apparatus as set forth in claim 1 and further including a pressure retaining means in said tubular inner member.

3. The apparatus as set forth in claim 1 wherein said slip actuator means includes dog members received in a recessed portion of said slip means.

4. The apparatus as set forth in claim 3 wherein said release means is a shear pin.

5. The apparatus as set forth in claim 3 wherein said spring means are disposed within said cylinder.

6. The apparatus as set forth in claim 3 and further including means releasably interconnecting said hydraulic-mechanical actuator means and said slip actuator means.

7. The apparatus as set forth in claim 6 wherein said interconnecting means for releasably interconnecting said inner and outer member and said means releasably interconnecting said hydraulic-mechanical actuator means and said slip actuator means, respectively, are thread means which are releasable upon rotation of said inner member relative to said outer member.

8. The apparatus as set forth in claim 7 wherein said means releasably interconnecting said hydraulic-mechanical actuator means and said slip actuator means are separated prior to separation of said interconnecting means for releasably interconnecting said inner and outer member.

9. A setting tool and liner hanger for setting a liner in a well bore transversely earth formations which include:

a tubular outer member adapted for coupling to a liner;

slip means in said outer member movable between an initial unset position to a setting position in engagement with the wall of a wellbore, a setting tool having an tubular inner member arranged for coupling to a work string, a threaded nut slidably and non-rotatively carried by said inner member for releasable threaded interconnection with an internal threaded portion of said outer member;

hydraulic-mechanical actuator means carried by said inner member and having a hydraulically actuated cylinder movable between a contracted and an extended position, spring means cooperating with said cylinder for providing a spring force for moving said cylinder between the contracted and the extended positions, slip actuator means connected to said hydraulic-mechanical actuator means, said slip actuator means having dog members in engagement with said slip means for moving said slip means between an unset position and a setting position when said hydraulic-mechanical actuator means moves between a contracted and extended position, means for releasing said dog members from engagement with said slip means upon relative movement between said inner and outer members, and release means for releasably interconnecting said slip actuator means to said inner member, said release means being operable in response to relative movement between said slip actuator means and said inner member.

10. The apparatus as set forth in claim 9 wherein said release means includes a shear pin.

11. The apparatus as set forth in claim 9 wherein said spring means are disposed within said cylinder.

12. The apparatus as set forth in claim 9 wherein said slip actuator means are threadedly connected to said hydraulic-mechanical actuator means by threaded connection means.

13. The apparatus as set forth in claim 12 wherein said threaded connection means is arranged for release prior to release of said threaded nut.

14. The apparatus as set forth in claim 9 wherein said means for releasing said dog members includes an annular recess on said inner member.

15. The apparatus as set forth in claim 14 and further including means for locking said dog members in a fixed position in said annular recess upon release of said dog members from said slip means.

16. A setting tool and liner hanger for setting a liner in a well bore traversing earth formations which include:

a tubular outer member adapted for coupling to a liner;

slip means in said outer member movable between an initial unset position to a setting position in engagement with the wall of a wellbore, a setting tool having an tubular inner member arranged for coupling to a work string, a threaded nut slidably and non-rotatively carried by said inner member for releasable threaded interconnection with an internal threaded portion of said outer member;

hydraulic-mechanical actuator means carried by said inner member and having a hydraulically actuated cylinder movable between a contracted and an extended position, spring means cooperating with said cylinder for providing a spring force for moving said cylinder between the contracted and extended positions, slip actuator means connected to said hydraulic-mechanical actuator means, for engagement with said slip means for moving said slip means between an unset position and a setting position when said hydraulic-mechanical actuator means moves between a contracted and extended position, and release means for releasably interconnecting said slip actuator means to said inner member, said release means being operable in response to relative movement between said slip actuator means and said inner member.

17. The apparatus as set forth in claim 16 wherein said release means includes a shear pin.

18. The apparatus as set forth in claim 16 wherein said slip actuator means are threadedly connected to said hydraulic-mechanical actuator means by threaded connection means.

19. The apparatus as set forth in claim 18 wherein said threaded connection means is arranged for release prior to release of said threaded nut.

20. The apparatus as set forth in claim 19 wherein said spring means are disposed within said cylinder.

21. The apparatus as set forth in claim 16 wherein said means for engagement includes dog members and means for releasing said dog members.

22. The apparatus as set forth in claim 21 and further including means for locking said dog members in a fixed position relative to said annular recess.

23. A setting tool and liner hanger for setting a liner in a well bore traversing earth formation which include:

a tubular outer member adapted for coupling to a liner, said outer member having slip means circumferentially disposed about said outer member and arranged for movement between a contracted unset position within the circumference of the outer surface of the outer member and an extended setting position where the slip means engage the wall of a well bore;

a setting tool having a tubular inner member arranged for coupling to a drill or work string, interconnecting means for releasably interconnecting said inner member and said outer members, hydraulic actuator means carried by said inner member and having a hydraulic cylinder movable between contracted and expanded positions, said cylinder having access to the bore of said inner member for the application of hydraulic pressure;

slip actuator means for moving said slip means in response to operation of said hydraulic actuator means, said slip actuator means includes dog members received in a recessed portion of said slip means, release means for releasably retaining said actuator means in a contracted position on said inner member, said release means being operable in response to hydraulic pressure to said cylinder; and means releasably interconnecting said hydraulic actuator means and said slip actuator means.

24. The apparatus as set forth in claim 23 wherein said interconnecting means for releasably interconnecting said inner and outer member and said means releasably interconnecting said hydraulic-mechanical actuator means and said slip actuator means, respectively, are thread means which are releasable upon rotation of said inner member relative to said outer member.

25. The apparatus as set forth in claim 24 wherein said means releasably interconnecting said hydraulic-meahcnical actuator means are separated prior to separation of said interconnecting means for releasably interconnecting said inner and outer member.

26. The apparatus as set forth in claim 25 wherein said means releasably interconnecting said hydraulic-mechanical actuator means and said slip actuator means includes an annular recess in said inner member.

27. The apparatus as set forth in claim 26 and further including means for locking said dog members in a fixed position in said annular recess upon release of said dog members from said slip means.

28. The apparatus as set forth in claim 23 and further including a ball seating means in said tubular inner member.

* * * * *